US005176082A

United States Patent [19]

Chun et al.

[11] Patent Number: 5,176,082

[45] Date of Patent: Jan. 5, 1993

[54] SUBWAY PASSENGER LOADING CONTROL SYSTEM

[76] Inventors: Joong H. Chun, 5205 Brougham La., Plano, Tex. 75023; Hanjoo Lee, 1604 Brazos Trail, Plano, Tex. 75075

[21] Appl. No.: 688,737

[22] Filed: Apr. 18, 1991

[51] Int. Cl.[5] ..... B61B 1/00

[52] U.S. Cl. ..... 104/28; 105/341; 105/341.5; 105/344; 246/209

[58] Field of Search ..... 104/27, 28, 30; 105/341, 341.5, 344, 343; 246/166.1, 209; 340/436, 674, 555, 991, 994

[56] References Cited

U.S. PATENT DOCUMENTS

| | | | |
|---|---|---|---|
| 1,462,868 | 7/1923 | Newman | 104/30 |
| 2,098,460 | 11/1937 | McWhirter | 105/341.5 |
| 3,587,472 | 6/1971 | Bissett | 104/27 |
| 3,788,232 | 1/1974 | Schneider et al. | 104/28 X |
| 4,009,389 | 2/1977 | Lindholm | 340/555 X |
| 4,092,718 | 5/1978 | Wendt | 340/994 X |
| 4,127,766 | 11/1978 | Thayer | 340/674 X |

FOREIGN PATENT DOCUMENTS

| | | | |
|---|---|---|---|
| 257665 | 10/1989 | Japan | 246/209 |
| 81742 | 3/1990 | Japan | 105/341 |
| 102842 | 4/1990 | Japan | 105/341 |

*Primary Examiner*—Robert J. Oberleitner
*Assistant Examiner*—Kevin D. Rutherford
*Attorney, Agent, or Firm*—James L. Jackson

[57] ABSTRACT

A passenger detection loading and unloading control system is provided for high volume passenger transporters such as subway trains and the like which electronically counts the passengers in each passenger compartment and prepositions passengers that intend to deboard at the next passenger loading and unloading platform and which electronically counts and prepositions a number of passengers at the next platform for boarding. The system further permits simultaneous loading and unloading of passengers without interference with passenger flow. Passengers on the transporter are numerically counted and those passengers intended to deboard the transporter at the next platform are also counted. Signals representing these counted passengers are continuously transmitted to a signal processing facility for processing. A predetermined time schedule for arrival and departure is established for the high volume passenger transporter in relation to each passenger loading and unloading platform. The processed passenger information from the transporter is communicated to the platform and utilized for controlling maximum loading of the transporter in compliance with the predetermined time schedule so that the transporter system functions in its most efficient passenger handling manner and keeps all transporters operating on the preestablished time schedule.

11 Claims, 3 Drawing Sheets

FIG.1
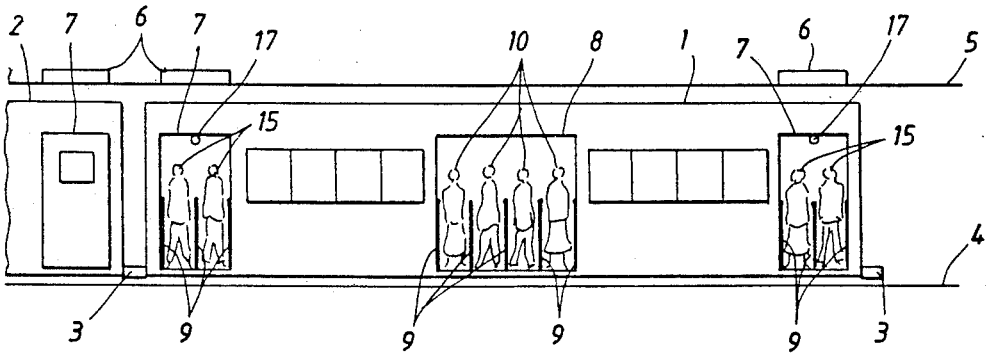
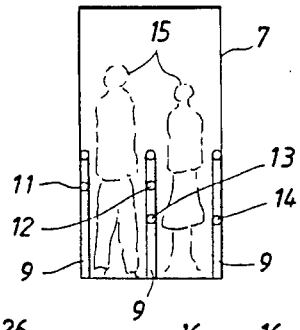
FIG.2
FIG.3
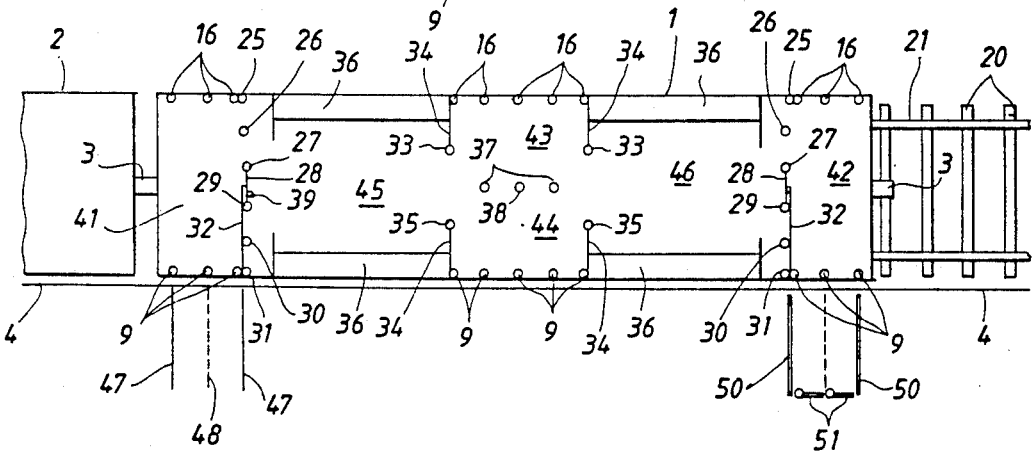
FIG.4
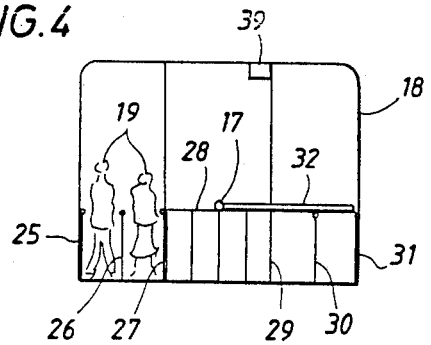
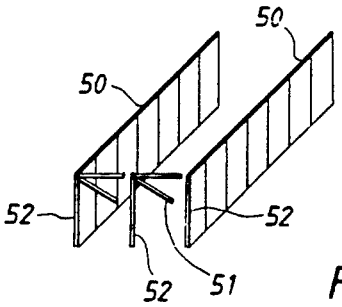
FIG.5

FIG. 11
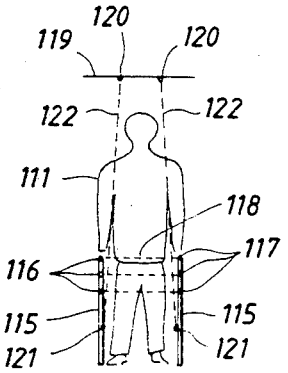
FIG. 12
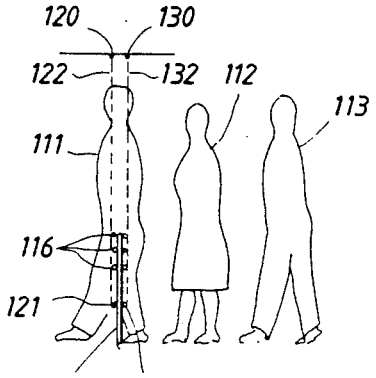
FIG. 13
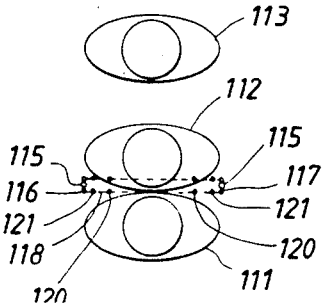
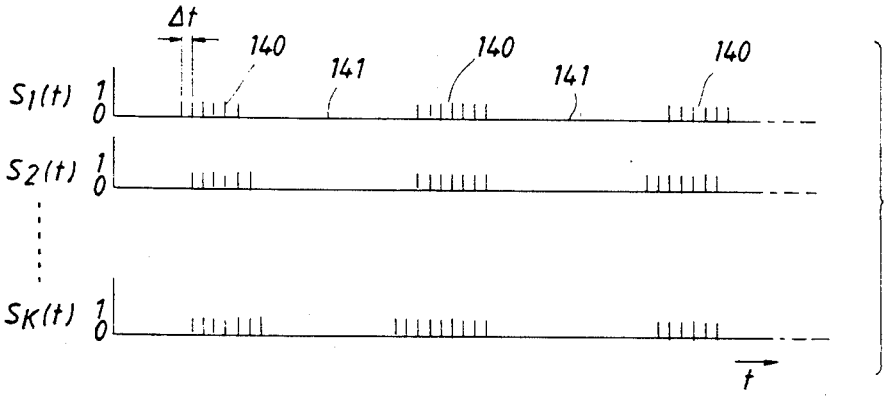
FIG. 14
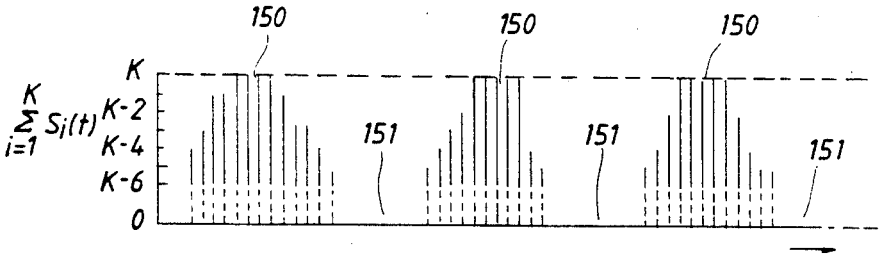
FIG. 15
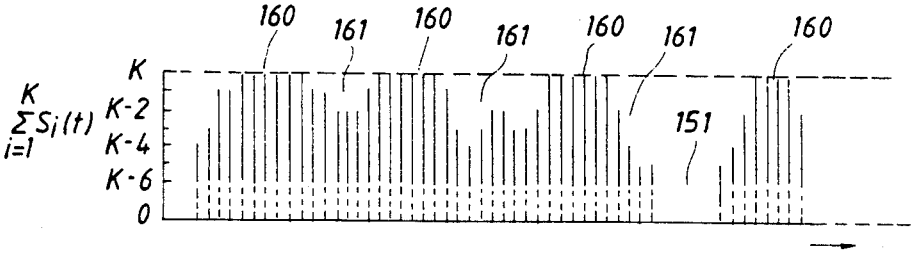
FIG. 16

SUBWAY PASSENGER LOADING CONTROL SYSTEM

FIELD OF THE INVENTION

This invention relates generally to subway systems for mass transit of passengers in cities and more particularly concerns a subway passenger loading and unloading control system that minimizes subway overcrowding and renders the subway passenger handling system more efficient.

BACKGROUND OF THE INVENTION

This invention is described herein particularly as it relates to subway train systems and passenger control therefor. It is to be understood, however, that this invention has efficient application in any facility where passenger control is desired and therefore the example herein should not be limiting of the scope of this invention.

It is well known that a subway is one of the most efficient passenger transportation systems in a large city. However, most of the subways in the world are confronted with a traffic congestion problem during rush hours. This congestion is mainly caused by overloading of passengers into the subway which exceeds the limits of transportation capacity of the system. Train travel time delays and over crowding of subway train compartments during rush hours are a direct result of this over-loading.

Two of the most important factors which govern the capacity of a subway transportation system are the subway train travel time from the station of origin to terminus and the maximum number of subway trains dispatchable during rush hours.

The total travel time (TOT) of a subway train from the station of origin to terminus is generally composed of three time elements: 1) the sum of subway train interval travel time between two adjacent stations; 2) the sum of passenger unloading and loading time at each station; and 3) the sum of extra waiting time in a station due to some uncontrollable circumstances. The maximum number of subway trains dispatchable (MTD) for a given time duration depends on TOT and the minimum distance on time interval allowed between two consecutive subway trains (MIT). It is obvious that the more subway trains that are dispatched, the more people can be transported but it is practically limited by the MTD. Since the MIT is more or less a fixed quantity for a given subway system for safety reasons and particularly it reaches to the limit during the rush hours, further reduction of the MIT is very unlikely. Thus it appears that the only viable option to increase a subway system's transportation capacity is to maximize the MTD by minimizing the TOT if we are constrained to utilize currently existing subway trains without any costly major remodifications to the subway system.

In order to minimize the TOT of subway systems, all three time elements of the TOT should be minimized:

1) Interval Travel Time (ITT)

Since the maximum speed of a subway train is limited, the minimum ITT exists for each station interval. The minimum subway train run time can be defined as the sum of minimum ITT and this quantity is a constant and can be attained in an ideal situation only. The real value of ITT during rush hours is very likely greater than the minimum ITT due to the slow down of a subway train caused by the loading and unloading delay of preceding subway trains. In order to minimize extra ITT delay, it is necessary to implement a method which will force each subway train to keep a preset or preprogrammed station stop time for each station without any exceptions.

2) Passenger Loading and Unloading Time (PLT)

This is the most critical time element within the TOT which increases the most during rush hours; and, effective reduction of PLT is the key for minimization of the TOT. Currently, a significant increase of PLT during rush hours is mostly caused by over-crowding of passengers and the lack of an efficient passenger loading control system in the existing subway train system.

Most currently existing subway trains employ a two-door design. Each door is being utilized for both passenger loading and unloading so that the passenger flow through the door is bi-directional. It appears that the PLT for a bi-directional door system is almost twice that of the mono-directional door system which allows passengers to get in through an "Entrance Only" door and get out through an "Exit Only" door. (For example, a street car with three doors, two end doors assigned for "Entrance Only" and the middle for "Exit Only"). This is because in the bi-directional door system passenger loading can only begin after the passenger unloading is completed, while for the mono-directional door system, the unloading and loading process can be done concurrently. The bi-directional door system has further problems under a crowded environment during rush hours. Usually, passengers inside of the subway train who stand near the exit door and passengers on the platform ready to get on the subway typically block the accessway for passengers who wish to get off and this further delays the passenger unloading process. On the other hand, for mono-directional door systems, the flow of passengers within a subway train compartment is mono-directional (entrance to exit) and no passenger on the platform will block the exit door thus, the unloading process will be more efficient than a bi-directional door system.

3) Extra Waiting Time

It appears that most of the subway train extra waiting time during rush hours is caused by the over crowding of passengers at several bottle neck subway stations. For example, at these bottleneck stations, some passengers try to get on already crowded subway trains and hang on near the door. This prevents the closing of subway train doors and causes further delay of departure of the subway train. Currently, subway operators of several large cities (Tokyo, Seoul, etc.), solve this problem by assigning passenger pushers to push passengers into the subway car compartment in order to close the door.

In order to solve rush hour subway traffic congestion problems, it is most desirable to implement a subway passenger loading control system which will accomplish the following:

1) Minimize passenger loading and unloading time.

2) Prevent over loading of passengers at each station for all subway trains at all times.

3) Make all subway trains maintain a preprogrammed stop time at each station.

This invention utilizes a computerized subway passenger loading and unloading monitoring system which is installed at each entrance and exit area as well as in the interior of subway train compartments. This enables us to keep track of the number of passengers entering and leaving the subway train as well as the flow of passengers inside of the subway train.

By knowing this vital passenger flow information within the entire subway system, it is possible to accomplish the passenger control system objectives described above.

BRIEF DESCRIPTION OF THE DRAWINGS

So that the manner in which the above recited features, advantages and objects of the present invention are attained and can be understood in detail, a more particular description of the invention, briefly summarized above, may be understood by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

FIG. 1 is a front view of a subway train stopped at the subway station platform showing the gates opened and the process of passenger loading/unloading in progress.

FIG. 2 is a detailed sketch of a subway train entrance gate where boarding passengers are entering the gate through pairs of passing passenger sensing posts.

FIG. 3 is a top view of a subway train car compartment after removing the roof to show the partitioning of the interior area of the subway train compartment into three functional zones namely: entrance zone, seat zone, and exit zone.

FIG. 4 is a detailed view of the boundary between the entrance zone and the seat zone.

FIG. 5 is a perspective view of the passenger loading area fence system which might be used only for the congested subway station where very strict passenger loading control is needed.

Figure 6:
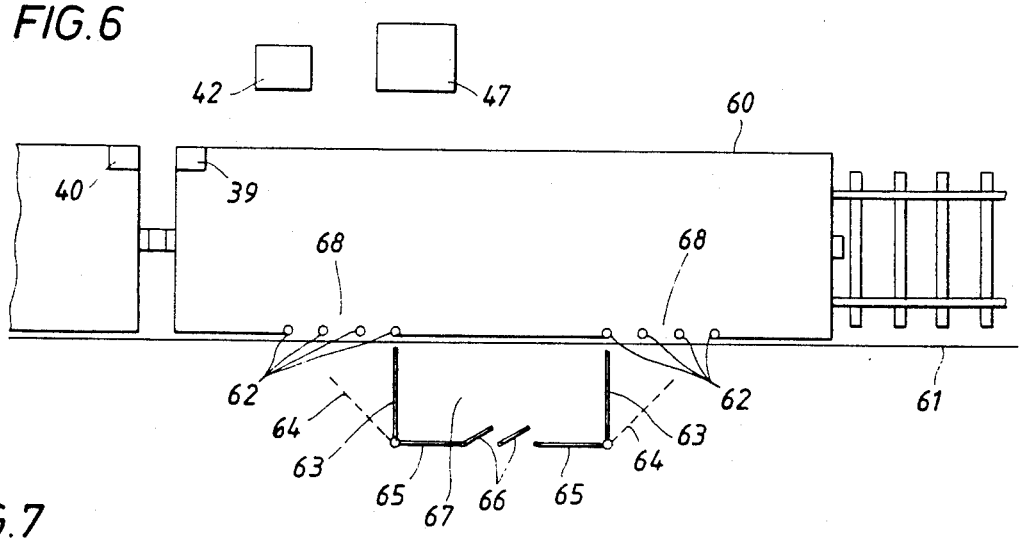

FIG. 6 is a top view of a two-gate subway train car compartment after removing the roof to show the arrangement of passing passenger sensor system and passenger loading system.

Figure 7:
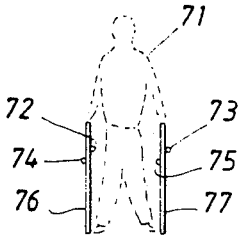

FIG. 7 is a view of the two-way passing passenger sensing post.

Figure 8:
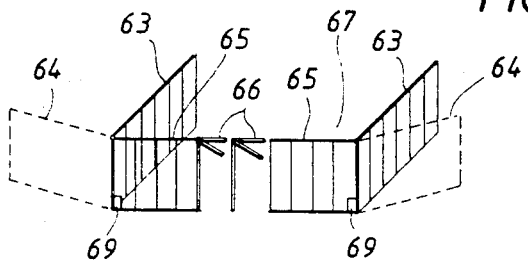

FIG. 8 is perspective view of the passenger loading area fence system for the two-gate subway train.

Figure 9:
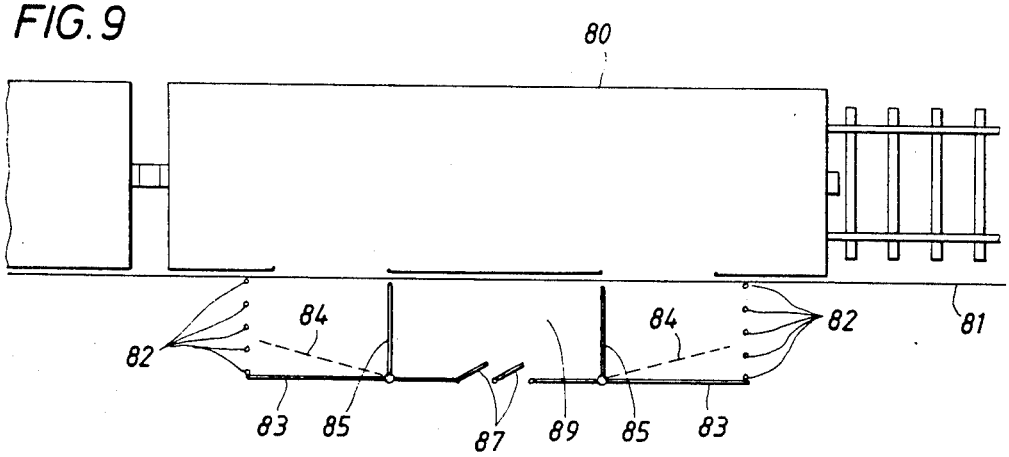

FIG. 9 is a top view of a conventional two-gate subway train without any sensor posts.

Figure 10:
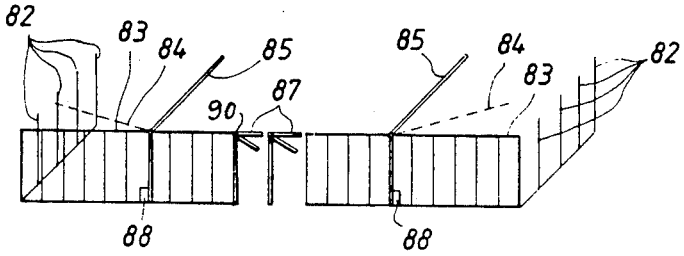

FIG. 10 is a perspective view of the passenger load area fence with the passing passenger sensing posts on the platform.

FIG. 11 is a front elevational view of a passenger control gate constructed in accordance with the present invention and being provided with a multiple sensor system for passenger detection.

FIG. 12 is a side elevational view of the multiple sensor passenger detection gate of FIG. 11.

FIG. 13 is a plan view of the multiple sensor passenger detection gate of FIGS. 11 and 12, illustrating the presence of passengers in relation to the gate.

FIG. 14 is a graphical representation of sequentially numbered sensors for a subway passenger control facility that functions according to the present invention.

FIG. 15 is a graphical representation of a time series being the simple sum of a number of timed series relating to passenger separation in the passenger control system.

FIG. 16 is a graphical representation of the summed sensor time series which is likely to occur during rush hours.

DETAILED DESCRIPTION OF THE PREFERRED EMBODIMENT

As shown in FIG. 1, two subway train cars 1 and 2 are connected by a subway train coupling 3. The subway train is stopped along the subway station platform 4 and an electrical passenger loading information display panel (or TV monitor) 6 is suspended from the station platform ceiling 5. Three passing passenger sensing (PPS) posts 9 are installed at the subway train entrance gate 7 and two boarding passengers are shown to be entering the subway train by passing between a pair of PPS posts 9 which will be used for counting the number of passengers entering into the subway train through this entrance. At the centrally located exit gate 8, five PPS posts 9 are installed and four deboarding passengers 10 are shown to be exiting the subway train parallel by passing between pairs of PPS posts 9 which serve for counting the number of passengers deboarding the subway train through this gate.

Passenger loading traffic control signal 17 which is controlled by a computer installed in the subway train, has green and red lights; the green light signaling "Enter", and the red light signaling "Do Not Enter". The red light will be illuminated either when the number of passengers on board equals or exceeds the maximum capacity of the subway train compartment or a few seconds prior to the closing of the entrance gate in order to warn boarding passengers to stay on the platform so that the door can be closed without blocking.

With reference to FIG. 2, the entrance gate 7 of the subway train is shown in detail. Infrared beam transmitters 11 and 13 and their respective beam receivers 12 and 14 are attached to the PPS posts 9 so that the entering passengers 15 will block the beam when they pass between the transmitter and receiver pairs. Each blocking will be counted as one passenger passing and thus count will be transmitted to the on-board computer to be described in detail hereinbelow.

FIG. 3 is a plan view of the interior of a typical subway train compartment which shows a passenger movement monitoring sensor system to monitor the movement of passengers inside the subway train compartment. The subway train 1 is located on rails 21 which are supported in conventional manner by railroad ties 20. The subway car is shown to be stopped adjacent the passenger platform 4. All PPS posts installed on the platform side of the subway train gates are identified by reference numerals 9 and all PPS posts installed in the subway train gates in the opposite side of the passenger platform are depicted by reference numerals 16. The interior space of the subway train 1 is functionally divided into three zones by the sensor system. The front and rear entrance zones 41 and 42 are defined as an area combined by the PPS posts in the front and rear of the subway car 16, 25, 26, 27, 29, 30, 31 and 9. The passenger compartment includes front and rear passenger sitting zones 45 and 46 which are respectively defined by PPS posts 25, 26, 27, 29, 30, 31, 35, 37, and 33.

The platform side and the opposite side of the platform exit zones 44 and 43 are respectively defined by PPS posts 9, 35, 37, 38, 37, and 34 and by PPS posts 16, 33, 37, 38, 37, and 34. Among the three zones, the entrance and exit zones are designated for standing passengers only, while there are seats in the passenger sitting zones 45 and 46. The sitting zone fence 34 is a barrier between the sitting and exit zones which has the purpose of causing passengers to move through the passenger sensors placed in between these two zones. The boundary between the entrance and the sitting zones is defined by an array of PPS posts 25, 26, 27, 29, 30 and 31. On the passenger platform, the passenger loading area located in front of the subway train entrance 7 is marked with a pair of solid lines 47 and a dotted line 48 for waiting passengers to line up. For some heavy traffic subway stations, the passenger loading area may need to be designated by a loading area fence 50 and gates 51. A prospective view of this fence diagram is depicted in FIG. 5 and will be described in detail hereinbelow. It should be pointed out that all sensors are connected with well shielded wires to the subway train compartment mini-computer 39. A computer 39 on each subway train car is linked to the subway train passenger monitoring computer 40 located in the subway train operators compartment (as shown in FIG. 6).

While the subway train is traveling through the underground tunnel of the subway system, the subway train passenger monitoring computer 40 will continuously transfer information pertaining to the change of passenger distribution within each subway train compartment to a station computer 42 at the next passenger station or passenger loading and unloading platform wirelessly using cellular technology or other suitable means. All information received by the subway train station computer will be instantly relayed to a central passenger monitoring and control computer 47 by conventional means for further data processing.

The elevational view of FIG. 4 shows the boundary between the entrance zone 41 and the sitting zone 45 in detail. The platform side PPS posts 31, 30, and 29 are blocked by a rotating cross bar 32 which has a hinge point 17 at one end thereof. The cross bar rests on top of the partitioning fence 28 with the hinge point being located in the middle of the fence 28. The opposite side platform PPS posts 25, 26, 27 are open to admit passengers moving into the exiting zone. These sensors will monitor the number of passengers moving from the entrance zone 41 to the sitting zone 45. Location of the entrance to sitting zone passage at the opposite side of this platform entrance is most important for the full utilization of spaces in the entrance zone. Further, the passenger entrance zone is in essence a passenger loading buffer for the sitting zone. If the passage between these two zones is placed in the middle, one half of the entrance zone which is the opposite side of the platform will become a dead space from the standpoint of passenger utilization and its space will therefore be wasted. A passenger dead space of this nature could be equivalent to reducing the length of loading area for the sitting zone by one half and thus should not be tolerated in passenger compartment design.

FIG. 5 is a perspective view of a passenger loading area protection fence system which is located on the loading platform as shown in FIG. 3. If all passengers entering the entrance 7 of the subway train obey the rules of passenger courtesy and do not try to enter the subway car when the red light 17 is illuminated, this fence is not needed. A loading zone fence 50 and rotating gate 51 which are similar to the ones used in the subway station entrance, completely surrounds the loading zone. The gate 51 has an electronic passenger counting mechanism which is connected to the subway station computer and will physically limit the number of passenger entering to the loading zone at the passenger loading platform under the control of signals generated by the subway station computer. To prevent overcrowding of the subway train, it is necessary to control the number of passengers on board within the limit of the maximum passenger capacity for all subway train compartments. The total number of passengers on board a subway train compartment at any given time is simply the difference between the total number of passengers on-boarded through the entrance gates 7 and off-boarded through the exit gate 8. During rush hours, the subway train will be fully loaded beginning at some station away from the station of origin. Fully loaded implies that the number of passengers on board equals the designated capacity of the subway train compartment, but still there may be room available so that passengers can move around without too much difficulty. As soon as a fully loaded subway train closes all of its entry and exit gates and is ready for departure, an announcement will be made to request that passengers who will be deboarding at the next station move to the exit area (exit zone 44) which is most likely to be the least crowded at the time of departure due to unloading of passengers from this area at the current station. As passengers move from the sitting zones 45 and 46, to the exit zone 44, some vacant space (room) will occur in the sitting zone and this will allow passengers in the entrance zones 41 and 42 to move into the sitting zone 45 and 46 respectively. Since passengers go through the spaces between PPS posts 25, 26 and 27, the number of passengers moving from the entrance zones to the sitting zones is known. Thus the exact number of passengers remaining in the entrance zone is known as well. If some passengers remain in the entrance zones who should have moved to the sitting zones, the computer 39 will activate the speaker system in the entrance zones calling and requesting the passengers in the entrance areas move into the interior of the subway train to make room for passengers to be loaded in the next station. As passengers respond to this request, more passengers in the entrance zones will move into the sitting zone resulting in more passenger space availability in the entrance zones.

The change of passenger distribution within the entrance zones 45 and 46, and in the exit zones 43 and 44 will be continuously transferred to the computer at the next station, while the subway train is traveling to the next station. Utilizing the detailed passenger distribution information which is transferred from the computer on the moving subway train to the computer in the next station together with the preprogrammed stop time at the station, the computer at the central control facility will determine the optimum number of passengers that will be permitted to load in each subway car entrance.

It should be pointed out that the preprogrammed station stop time at each station should be strictly kept in order for all subway trains to operate on time as scheduled. Thus, the maximum number of passengers to be loaded will be limited to the number of passengers that can be loaded during the preprogrammed station stop time even if there are extra spaces available. Sometimes, it is possible that the central computer will command the unloading of passengers only and will not permit the loading of any passengers at less crowded stations, even if there is plenty of room available in the subway train compartment, in order to pick up more passengers (to ease an overcrowding problem) at a bottle neck station. In this way, overcrowding at a bottle neck station can be spread out to several less crowded stations. Once the optimum passenger loading decision is made, this information will be transmitted from the computer in the central passenger control facility to the computer in next station and this will be displayed on electronic passenger vacancy display 6 at the passenger platform prior to the arrival of the subway train. This feature will enable passengers to adjust their schedules or mode of travel in compliance with the condition of the subway system.

Displaying passenger vacancy information at each passenger entrance at the station prior to the arrival of the subway train is very important for more even loading of passengers in the subway cars. This is because passengers will seek and line up at the loading zone where vacancy on the subway train is indicated to be available. If no vacancy is available in any loading zone then they will line up where the length of the que minus the vacancy displayed is the smallest.

Since every effort is made to migrate passengers from the entrances to the sitting zones, and from the sitting zones to the exit zones, it is expected that the passenger density will be highest in the exit zones and lowest in the entrance zones when the subway train arrives at the next station. Speedy passenger loading is ensured simply because a predetermined number of passengers will already be well lined up and will be on-boarded to the free space provided in the entrance zones for each subway train compartment. Also, very speedy unloading of passengers is ensured simply because most of the deboarding passengers are already concentrated at the exit gate area of the subway train so that they can get off very quickly from the subway train to the platform. This speedy unloading process is further ensured simply because all boarding passengers are lined up in the loading areas which is typically sufficiently far away from the unloading area that no passenger counter flow will be encountered and thus the unloading area will be clear of passengers most of the time. After the unloading and the loading processes are simultaneously completed, all subway train gates will be closed and the subway train will be ready to move to the next station thus beginning the next passenger control cycle.

It should be pointed out that all of the subway passenger loading control system objectives which have been previously stated will be accomplished through employment of this invention.

Passenger loading/unloading time will be minimized through utilization of efficient concurrent loading and unloading through separate gates.

Over crowding of subway passenger cars will be prevented by electronically controlling the number of passengers that are permitted to board each car of the subway train.

The preprogrammed stop time at each station will be efficiently maintained by minimizing the passenger loading and unloading time.

The invention described is also applicable for the currently existing two-gate train car design as a passenger control system although it may not be as efficient as the three-gate car design and this is presented in FIG. 6 through FIG. 10.

Referring now to FIG. 6, a subway train 60 is shown to be stopped along side the passenger platform 61 and two gates 68 are shown to be open. Four PPS posts 62 are located at each loading gate. The passenger loading area 67 is surrounded by stationary fence 65, and fence gates 63, and passenger gate 66. Predetermined numbers of passengers will be permitted to enter the loading zone 67 through the gate 66 whose functionality is exactly the same as gate 51 shown in FIG. 5. A more detailed description of the gates 66 and their functions will be set forth hereinbelow. All passengers deboarding will pass between a pair of PPS posts 62 which are placed in the gate so that the number of passengers exiting from the subway train is electronically countable. Since the same gate will be used for boarding passengers there is a need to have the ability to distinguish the boarding and deboarding passengers.

FIG. 7 shows a pair of PPS posts with two way sensors. Two infrared beam transmitters 72 and 74 are installed on the same post 76 but they are positioned apart by a selected distance, such as one inch, for example. Their respective receivers 73 and 75 are also installed on the same post 77, and are also positioned apart by a selected distance, such as one inch. If a passenger enters from the forward direction, the beginning of the beam block time for sensors 74 and 75 pair will be approximately 30 milliseconds sooner than that of sensors 72 and 75. This will be the opposite if the passenger enters the space between the sensor pairs in the rearward direction. By comparison of the timing blocks the computer can distinguish the difference between boarding and deboarding passengers and more accurately keep track of the number of passengers that are present in each car of the subway train at any given time.

FIG. 8 is a perspective view of the loading area protection system of the loading platform which is quite similar to the system depicted in FIG. 5. The only difference is that the fence gate 63 is opened by motor 69 and rests at gate position 64, shown in broken lines, when most of the passengers have been off-loaded. This opening serves two purposes, first to open the passage to the subway train gates 68 for passengers in the loading area 67; secondly, to keep away passengers that are located outside of the loading zone for the subway train gates. The number of passengers that are present in the loading area is already counted. This number can be checked with the number counted by the sensors of PPS posts 62.

The passenger control system set forth in FIG. 9 is similar to that shown in FIG. 6 except that PPS posts 82 are placed in the platform installation instead of within the subway train gates.

The train car 80 will be of conventional nature and will not have passenger sensors of any kind. The platform passenger control station includes a central fence section having movable gates 87 and opposed extended fence sections 83. Movable fence or gate sections 85 are provided which cooperate with the central fence section to define a passenger loading or preboarding zone 89 for passengers who are counted by sensors as they enter through gates 87. During deboarding of passengers from the car 80 the movable fence or gate sections 85 are positioned as shown in full line to prevent entry of passengers from the preboarding zone 89 into the car. The deboarding passengers are counted as they pass through the sensor post arrays 82. After deboarding has been completed the gate or fence sections 85 are moved to the broken line positions 84 to thus permit movement of the passengers from the preboarding area 89 into the car 80.

The passenger control system set forth in FIG. 10 is similar to that shown in FIG. 8 except that it has an extended fence 83 and sensor posts 82 located on the platform rather than on the subway cars.

The passenger cars may therefore be of conventional nature as shown at 80 in FIG. 9. The platform passenger control installation is also similar to that shown in FIG. 9, the same reference numerals being used with reference to like passenger control components. The gates 85 may be positioned by the motor 88 which is of the same nature as gate motor 69 of FIG. 8.

To control passenger loading most efficiently, it is most desirable to know how many passengers will be off-boarded from each car compartment at each station in advance. To accomplish this objective a push button destination station indicator 90 (detail is not shown) is attached to each passenger entry gate 87 which is also connected to the central computer system. To enter to the loading zone through gate 87, each passenger must push a button among an array of buttons which correspond to his destination station otherwise the gate 87 will not be opened. By knowing each passenger's destination when they are entering to the loading zone, the computer can identify the number of passengers to be off-boarded from each car compartment at each station well in advance and this information will be utilized for admitting the correct number of passengers to the loading area prior to the arrival of the train. As soon as the train car does open on train arrival at each station, the pre-admitted passengers will be able to board immediately simultaneously with deboarding of passengers that have reached their destination.

The systems shown in FIGS. 9 and 10 are such that no modification is required on the subway train structure itself and all passenger control system components are installed on the platform and positioned for registry with the entrance gates and exit gates of the subway cars.

If the system depicted in FIGS. 1 to 5 is implemented, all sensor systems are located inside of the subway train and the passenger loading platform area remains unaltered.

The passenger loading and unloading control system of the present invention is intended to function as a solution for prevention of passenger overcrowding and it must function reliably under crowded conditions as typically occur during rush hours in large cities. If passengers are passing through the passenger system, whether located on a subway car, on the passenger platform, or on both and are passing the sensors one person at a time, then a simple sensor system such as those employed for elevator control systems might serve the purpose. However, if a group of passengers are jammed and pass through the sensor system, then reliable passenger counting with a simple sensor system becomes doubtful.

Infrared beams, laser beams, ultrasonic waves, electromagnetic waves, thermal sensors, etc. are all potential candidates to serve as sensors for purposes of the present invention. Whatever type of signal (beam or waves) are employed for the sensor system, transmission and reflection methods are the most widely utilized methods and both methods are applicable for purposes of the present invention.

The transmission method places transmitter and receiver pairs in face-to-face relation and thus permits a passenger to pass through the spaces between the sensor pairs to thus interrupt the beam projecting from the transmitters to the receivers. The number of passing passengers are known by counting the number of times the sensor beam is interrupted. The reflection method places the transmitter and receiver on the same side and the passing passengers reflect the signal from the transmitter and cause the reflected signal to be detected by the receiver. Thus the number of passengers passing the sensors become known by detecting the presence or absence of reflected signals by the sensor system as a function of time.

Whether the transmission or reflect ion methods are employed, it is most desirable to utilize multiple sensor systems in order to improve the accuracy of passenger counting. As mentioned above, it is highly desirable that passenger counting be accomplished with some degree of accuracy. Although, 100% efficiency is not absolutely required. The term "multiple sensor system" implies either the utilization of many transmitter and receiver pairs or the use of an array of receivers per each transmitter or a combination of both. These multiple transmitter/receiver pairs can be arranged in three dimensions. There is an unlimited number of ways of designing the passenger counting sensor system and therefore, for purposes of the present invention, any passenger sensor and counting facility may be employed without departing from the spirit and scope of this invention. In order to demonstrate the feasibility of the system, one simple design example will be presented as follows:

FIGS. 11 and 12 are respectively front and side views of a passenger gate that is provided with a multiple sensor system. In FIG. 11 passenger 111 passes through the space between a pair of sensor support posts 115. Elements 116 and 117 are multilevel beam transmitter and receiver pairs installed on the posts 115. A horizontal beam 118 is transmitted from the transmitter 116 to the receiver 117. Reference numeral 119 identifies the ceiling of the passenger compartment within the passenger car of a subway train. Slant beam transmitters 120 are positioned at the ceiling 19 of the passenger compartment and transmit the beams which are received by slant beam receivers which are located at the lower portion of the sensor support posts 115. Alternatively, the slant beam receiver 121 may be located at the floor of the subway car so as to establish vertical orientation for the beam, but it is not desirable to place the receiver on the floor for obvious reasons. The interval between a pair of vertical beam transmitters 120 is approximately one foot and their respective receivers 121 are approximately two feet. The reason for this spacing will be explained in detail hereinbelow. It should be pointed out that all horizontal beams 18 and slant beams 22 are co-planar. In other words, they are in the same vertical plane and conceptually forms a vertical beam curtain having minimal thickness.

FIG. 12 is a side elevational view of the multiple sensor system of FIG. 11. Transmitters 120 and beams 122 are located in co-planar relation with the front vertical curtain and transmitters 130 and beams 132 are co-planar with the rear vertical beam curtain. The front and rear vertical beam curtains therefore define two parallel vertical planes and the gap or space between these two planes should not exceed a few inches since the gap or space between the front and rear sensor curtains is much smaller than the thickness of the body of a passenger, all beams on both curtains will be interrupted concurrently for some point of time during the period when a passenger 111 passes through the sensor system as shown in FIG. 12.

With reference now to FIG. 13, there is illustrated an enlarged plan view of the sensor system with passengers 111, 112 and 113 shown in relation to the sensor system. As can be seen in FIG. 13, the back of the front passenger 111 and the front of the next passenger 112 are in contact as they pass through the gate defined by the sensors. In this situation, the horizontal beam 118 projecting from transmitter 116 to the receiver 117 will be continuously interrupted during the passage of both passengers through the gate and thus passengers 111 and 112 will be counted as a single passenger. On the other hand, the slanted beam 122 being projected from transmitter 120 to receiver 121 will be uninterrupted, thus the separation between passengers 111 and 112 can be recognized. In the event both passengers 111 and 112 should be bent forwardly with the upper body portions thereof in contact at the time they pass through the gate defined by the sensors, then the slant beam may fail to recognize the separation between the two passengers while the horizontal beam is very likely to be uninterrupted so that the separation of these two passengers can be electronically recognized. The passenger 113 is well separated from the passenger 112 so that all of the sensors will be uninterrupted after the passenger 112 has passed through the gate and before the passenger 113 has initiated entry through the gate. Accordingly, separation between passengers 112 and 113 would not present a problem from the standpoint of passenger counting.

Although it is not shown in the drawings, the voltage detected by each receiver, which is an analog signal, will be digitized continuously with a predetermined sampling interval (perhaps 2 to 4 milliseconds). During the period when the beam is uninterrupted, the signal state will be defined as zero and when the beam is interrupted, the signal state will be defined as one (1) as shown in FIG. 14. In FIG. 14, it is assumed that there is a total of (k) numbers of sensors for each monitoring system and they are numbered sequentially. $S_1(t)$, $S_2(t)$, . . . , $S_k(t)$ represent a digitized time series monitored at receivers 1, 2, . . . k, respectively. Delta (t) is the sampling interval of the time series. If the passengers are well separated and thus pass in well separated relation through the sensor system, then these will be identified by a group of samples with a positive value of one (1) 140.

The duration of the period 140 depends on the speed of passenger movement and the thickness of the body of the passenger. The periods of zero values shown at 141 must alternate with the positive values as shown in FIG. 14. A sequence of alternating positive and zero values 140 and 141 will represent the passing of one passenger through the sensor gate.

The digitized sampled time series from each receiver will be transmitted to the central computer by means of a modem or any computer network for further processing. The time series representation of FIG. 15 is a simple sum of k number of time series when each passenger is well separated. When a passenger is positioned to completely interrupt all sensors at a given time, the summed value will be equal to k as shown at 150. During the time that no passenger is present in a position to interrupt any of the sensors, then the sum as shown in the graphical representation of FIG. 15 will be zero as identified by reference numeral 151.

FIG. 15 is a graphical representation of the sum sensor time series signals which will very likely occur during rush hours when large numbers of passengers will be passing through the sensor gates in closely spaced, perhaps touching, perhaps overlapping relation. In this case, not all sensor will be uninterrupted completely between adjacent passengers. Consequently, the resulting summed sensor time series will depict a completely interrupted state 160 followed by a partially interrupted state 161 or a completely uninterrupted state 151 These sensor time series conditions will alternate as passengers pass through the gate as shown in the graphical representation of FIG. 16. A pair of completely interrupted time series 160 with either a partially interrupted time series 161 or completely uninterrupted time series 151 will represent movement of one passenger through the sensor gate.

It should be pointed out that a central horizontal beam or slant beam sensor alone has potential to count two passengers as one, but the combined use of both horizontal and vertical beams for passenger detection reduces the probability of the occurrence of passenger miscount. By arranging transmitters and receivers in three dimensional relation, it is possible to design a system that will further reduce the probability of the occurrence of passenger miscount.

Continuous digitization of an output voltage from a sensor is a well proven technology in the area of telecommunications, seismic survey, automatic system control, etc. Some existing systems can handle thousands of sensors simultaneously and the digitized time series can be transmitted to a computer and processed in real time on a routine basis.

Since infrared and laser beam sensors, analog to digital converters, multi-channel multiplexers and personal computers are all commercially available, the passenger counting system of the present invention can readily benefit through use of existing technological components, thus promoting a wide range of design alternatives and alternative embodiments that are will within the scope of the present invention. It appears that the degree of sophistication of the passenger detection and control system will largely depend on the desired accuracy of the counting system. If the desired accuracy is 100%, then obviously, the counting system needs to be of fairly complex nature. On the other hand, if the passenger counting and control sensor system has a design accuracy of say 98% or so, then the simple design examples set forth in this specification will adequately function for the intended purposes of the present invention.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A passenger detection loading and unloading control system for high volume passenger transit systems having passenger transporters each defining at least one passenger compartment for containing boarding and deboarding passengers at successive passenger boarding and deboarding platforms located along a passenger transporter route, comprising:

(a) means defining passenger boarding and deboarding zones within each of said passenger transporters;

(b) an electronic passenger counting system having a plurality of passenger detection sensors in said passenger compartments and on said passenger boarding and deboarding platforms and having a signal processing computer and monitor for substantially identifying the number of passengers entering respective boarding and deboarding zones of each of said passenger compartments to thereby establish in the passenger compartment the number of passengers preparing to deboard at a passenger loading and unloading platform;

(c) means electronically sensing the number of passengers present within said passenger boarding and deboarding zones of said passenger loading and unloading platform; and (d) means communicating to said signal processing computer signals representing the number of passengers within said passenger deboarding zones of said passenger transporters and the number of passengers located within said passenger boarding zones of said passenger loading and unloading platform and providing the number of passengers allowed within said passenger boarding zones in correspondence to the number of passengers present within said passenger deboarding zones, whereby simultaneous boarding and deboarding of passengers may take place within a minimal time period without risk of passenger overcrowding.

2. The passenger detection, loading and unloading control system of claim 1 wherein said means defining passenger boarding and deboarding zones comprises:

a plurality of passenger detection sensors of said electronic counting system being located on said high volume passenger transporter and defining passenger sensor gates for the purpose of counting boarding and deboarding passengers and for defining said passenger boarding and deboarding zones.

3. The passenger detection, loading and unloading control system of claim 1 wherein:

said electronic passenger counting system comprises a plurality of passenger detection sensors being located at said passenger loading and unloading platform and arranged to define said passenger boarding zones and passenger counting gates for passengers boarding and deboarding said high volume passenger transporter.

4. The passenger detection, loading and unloading control system of claim 1 wherein:

(a) said electronic passenger counting system includes a plurality of passenger counting sensors each having a transmitter and receiver and being selectively oriented to provide detecting signals when interrupted by the presence of a portion of the passenger's body between any transmitter/receiver pair to thus provide a counting signal; and (b) telemetry means for transmitting said passenger detection signals to said signal processing computer for said signal processing.

5. The passenger detection loading and unloading control system of claim 4 wherein:

(a) said signal processing computer of said passenger transporter is positioned within said high volume passenger transporter and is coupled in receiving relation with said plurality of sensors;

(b) a central processing computer is coupled by telemetry to said transporter computer to receive counting signal data therefrom: and (c) a station computer is located at said passenger loading and unloading platform and is coupled in receiving relation with said central computer and establishes correlated passenger control at said passenger loading and unloading platform in relation to said predetermined schedule of high volume passenger transporter movement and the numbers of passengers being handled during said movement.

6. The passenger detection loading and unloading control system of claim 1 wherein:

(a) said high volume passenger transporter defines a passenger compartment partitioned by said plurality of passenger detection sensors into at least one entry zone, at least one exit zone and at least one sitting zone, said entry and exit zones being spaced to permit simultaneous boarding and deboarding of passengers from said passenger compartment;

(b) said passenger detection sensors being arranged to identify the number of passengers being located in each of said entry, exit and sitting zones and identifying passenger movement within said passenger compartment from one of said zones to another; and (c) data processing means being located on said passenger transporter and being coupled in signal receiving relation with said plurality of passenger sensors and being further coupled with said communicating means for transmission of passenger location information to said signal processing passenger control and transporter control facility.

7. The passenger detection loading and unloading control system of claim 6 wherein said electronic passenger counting system includes:

(a) a plurality of passenger detection sensors being located at entrance and exit doors of said passenger compartment for counting boarding and deboarding passengers; and (b) a plurality of passenger detection sensors being located within said passenger compartment for detecting the location of passengers within said entry, exit and sitting zones of said passenger compartment.

8. The passenger detection loading and unloading control system of claim 1 including:

(a) passenger partition means being located at said loading and unloading platform and defining an enclosure for approved boarding passengers; and (b) means coupled with said central signal processing, passenger control and transporter control facility for admitting within said enclosure a selected number of passengers equaling the number of passenger vacancies on said passenger transporter and the number of passengers positioned for deboarding.

9. The passenger detection loading and unloading control system of claim 8 including:

movable partition means defining a part of said passenger partition means and being movable to selected positions for permitting deboarding of passengers from said passenger compartment followed by boarding of passengers from said approved passenger enclosure.

10. The passenger detection loading and unloading control system of claim 1 wherein said electronic passenger counting system includes:

pairs of sensor posts each having a plurality of sensors including transmitters and receivers located thereon and positioned in pairs and oriented for detection of portions of a passenger's body passing through the gate defined by said sensor support posts. the output of the various pairs of sensors being transmitted to said signal processor and defining a time series that is recognizable by said signal processor as representing each of the passengers even in the event the passengers are closely spaced or touching as they proceed through the passenger counting gate.

11. The passenger detection loading and unloading control system of claim 1. including:

means establishing a predetermined time schedule for arrival and departure of said passenger transporter in relation to said passenger loading and unloading platform and for controlling maximum loading of said passenger transporter in compliance with said predetermined time schedule even under circumstances where said maximum loading fails to fill said passenger transporter.

* * * * *